US005934066A

United States Patent [19]

Schmid et al.

[11] Patent Number: 5,934,066

[45] Date of Patent: Aug. 10, 1999

[54] COMBUSTION CHAMBER OF A GAS TURBINE WITH A RING-SHAPED HEAD SECTION

[75] Inventors: Achim Schmid; Manfred Schwithal, both of Berlin, Germany

[73] Assignee: BMW Rolls-Royce GmbH, Oberursel, Germany

[21] Appl. No.: 08/948,056

[22] Filed: Oct. 9, 1997

[30] Foreign Application Priority Data

Oct. 18, 1996 [DE] Germany ..... 196 43 028

[51] Int. Cl.[6] ..... F23R 3/24

[52] U.S. Cl. ..... 60/39.31; 60/752

[58] Field of Search ..... 60/39.11, 39.31, 60/39.32, 39.36, 39.37, 751, 752, 756

[56] References Cited

U.S. PATENT DOCUMENTS

| | | | |
|---|---|---|---|
| 4,870,818 | 10/1989 | Suliga | 60/756 |
| 5,181,377 | 1/1993 | Napoli et al. | 60/752 |
| 5,289,677 | 3/1994 | Jarrell | 60/39.31 |
| 5,323,601 | 6/1994 | Jarrell et al. | 60/39.32 |
| 5,419,115 | 5/1995 | Butler et al. . | |

FOREIGN PATENT DOCUMENTS

| | | |
|---|---|---|
| 2223839 | 4/1990 | United Kingdom . |
| WO96/04510 | 2/1996 | WIPO . |

*Primary Examiner*—Louis J. Casaregola
*Attorney, Agent, or Firm*—Pillsbury Madison & Sutro LLP

[57] ABSTRACT

A combustion chamber of a gas turbine with a ring-shaped head section, in which a front plate for receiving burners is provided, which are supplied with a primary airflow via annularly arranged air inlet openings in the head section, wherein the stagnation points being formed on the exterior of the head section (1) in respect to the inflow to the air inlet openings form a ring, within which the air inlet openings are located, and wherein furthermore the front plate has heat shields provided in the combustion chamber burner section and fixed in place by means of bolt connections. In addition, mounting openings for the bolt connections (11) are provided in the head section, wherein the backup points being formed on the exterior of the head section in respect to the inflow to the mounting openings form a ring, which is not located outside the ring formed by the backup points of the air inlet openings.

8 Claims, 3 Drawing Sheets

COMBUSTION CHAMBER OF A GAS TURBINE WITH A RING-SHAPED HEAD SECTION

FIELD OF THE INVENTION

The invention relates to a combustion chamber of a gas turbine with a ring-shaped head section, in which a front plate for receiving burners is provided, which are supplied with a primary airflow via annularly arranged air inlet openings in the head section, and wherein the front plate furthermore has heat shields provided in the combustion chamber burner section, which are fixed in place by means of bolt connections. In this case the backup points in respect to the flow into the air inlet openings which are formed on the outside of the head section in particular can form a ring within which the air inlet openings are located. Customarily the center of this ring coincides with the central axis of central longitudinal axis of the annular combustion chamber.

BACKGROUND OF THE INVENTION

A gas turbine combustion chamber in accordance with the preamble of claim 1 is represented in U.S. Pat. No. 5,419,115. From this reference it is not possible to discern more clearly how the bolt connections of the heat shields are mounted, but it can be assumed that the bolt nuts of the heat shields are applied to the threaded bolts penetrating the front plate in the space between the front plate and the head section, are introduced through the burner air inlet openings of the head section and are also tightened by means of a suitable tool through these air inlet openings. This operation is comparatively elaborate.

OBJECT AND SUMMARY OF THE INVENTION

It is the object of the invention to disclose a simplified assembly option without it being necessary because of this to have to accept disadvantages regarding the air flow conditions.

The attainment of this object is distinguished in that mounting openings for the bolt connections are provided in the head section, wherein the mounting openings are not located outside of the ring formed by the air inlet openings. In particular, the backup or stagnation points in respect to the flow to the mounting openings which are formed on the outside of the head section can form a ring which does not lie outside of the ring described by the stagnation points of the air inlet openings.

The invention will be explained in more detail by means of a preferred exemplary embodiment represented in the drawings.

DETAILED DESCRIPTION OF THE PREFERRED EMBODIMENT

Figure 1:
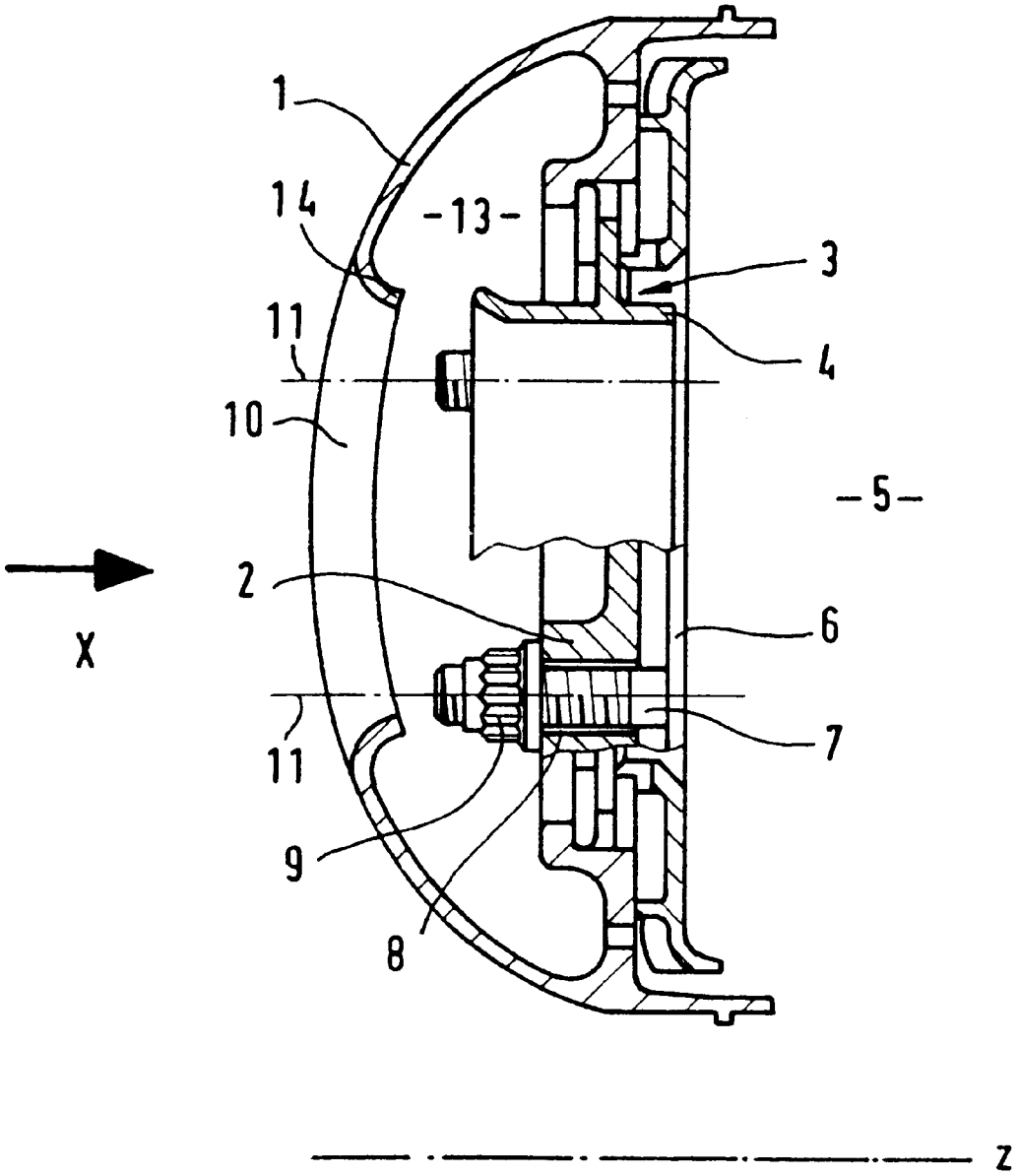
FIG. 1 represents a partial longitudinal section through a combustion chamber head section with the heat shield mounted.

The head section of an otherwise not further represented conventional annular gas turbine combustion chamber, which has a center axis or center longitudinal axis Z and in which a front plate 2 for receiving burners, not shown, is provided in the customary manner, is identified by reference numeral 1. To this end the front plate 2 has several annularly disposed through-openings 3, in which respectively one burner sleeve 4, known to one skilled in the art, is disposed. To protect this arrangement and the burners from the flame to be found in this combustion chamber burner section 5, annularly arranged heat shields 6 are provided at the front of this ring-shaped burner section 5, and are supported on the front plate 2. As usual, to this end each heat shield 6 has several (preferably four) threaded bolts 7, which penetrate through the front plate 2 in respective passages 8, so that on their rear, i.e. in the space 13 between the front plate 2 and the head section 1, it is possible to screw a bolt nut 9 on each threaded bolt 7.

Figure 2:
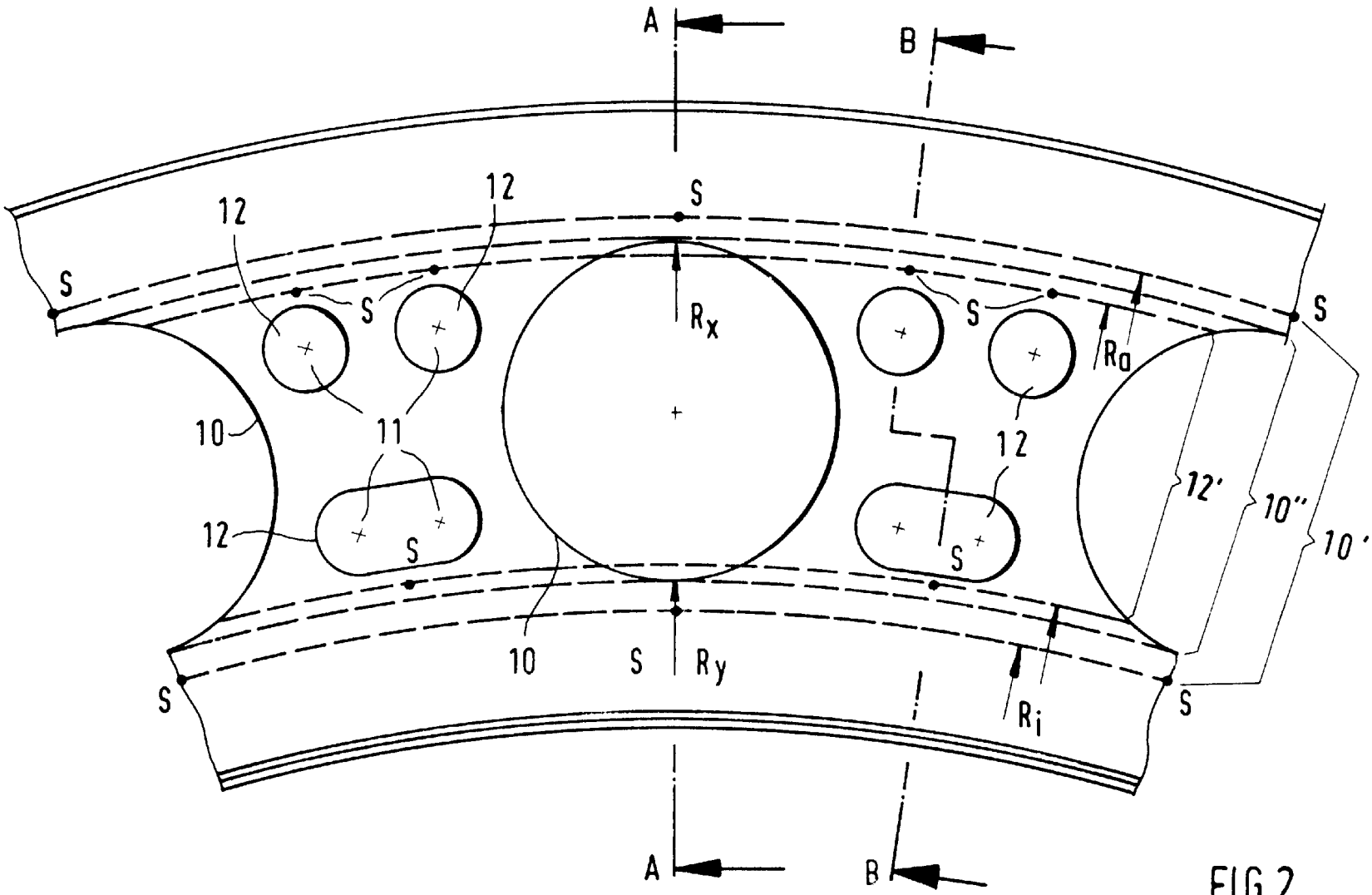
FIG. 2 shows the view X from FIG. 1.
Figure 3B:
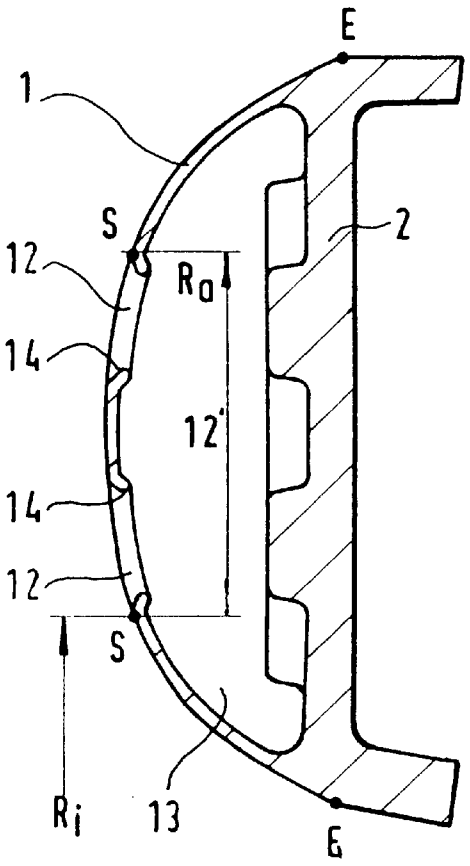
FIG. 3*b* shows the section B—B from FIG. 2.
Figure 3A:
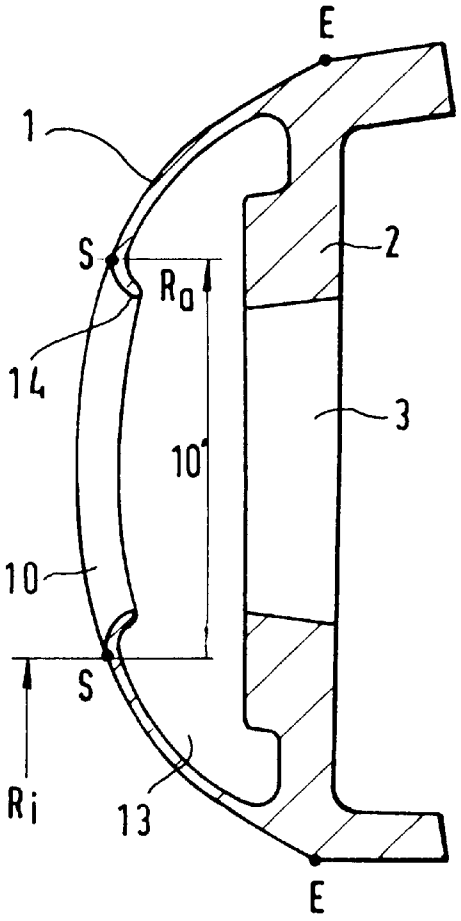
FIG. 3*a* shows the section A—A from FIG. 2.

The annularly arranged air inlet openings 10 for the burners can be seen in FIG. 2, wherein these air inlet openings 10 are arranged coaxially in respect to the through-openings 3, as shown in FIG. 3*a*. Furthermore, the center lines of the heat shield bolt connections 11 formed by the threaded bolts 7 and the bolt nut 9, are represented by crosses in FIG. 2. Now, in order to be able to mount these bolt connections 11 in a simple manner, i.e. to place the bolt nuts 9 in a simple manner on the threaded bolts 7 and to tighten them, suitably placed mounting openings 12, i.e. in particular extending coaxially with the bolt connections 11, i.e. coaxially with their center lines, are provided in the head section 1. Their design can also be seen in particular in FIG. 3*b*.

Although it is now possible to mount each bolt connection 11 in a simple manner through these mounting openings 12, i.e. each bolt nut 9 can be simply applied to the corresponding threaded bolt 7, a portion of the primary air flow for feeding the burners, which has reached the space 13 between the head section 1 and the front plate 2, could escape again through these mounting openings 12. To prevent this, the mounting openings 12 are arranged in accordance with the following description:

It is known that an airflow, which is conveyed by a compressor placed upstream of the combustion chamber, flows into the head section 1 of the combustion chamber in accordance with the direction of the arrow X. A portion of this airflow, conducted in accordance with the direction of the arrow X, reaches the burners through the air inlet openings 10 as well as the rear of the heat shields 6, however, the greater portion is conducted on the outside around the head section 1 in order to reach the combustion chamber burner section 5 in a downstream located combustion chamber area in the usual way through admixing openings in the exterior wall of the combustion chamber. In the backup points, identified by S (see FIG. 3*a*), the flow speed of the supplied air flow has the value "0", while static pressure has its maximum value. In the course of the flow around the outside of the head section, i.e. from the backup points S to the points E, an acceleration of the air flow with a simultaneous drop of the static pressure takes place. These flow conditions can not only be observed in the area of the air inlet openings 10 (see FIG. 3*a*), but also in the area of the mounting openings 12, through which air can basically also enter the space 13 in accordance with the direction of the arrow X in FIG. 1. Accordingly, the backup points in FIG. 3*b* are again identified by the letter S, and the points E are represented in the same way, toward which the airflow is guided along the outside of the head section 1, and wherein the said flow acceleration takes place simultaneously with the pressure drop.

Now, if all backup points S of the air inlet openings 10 located on the inside, viewed in the radial direction (in relation to the central axis Z of the combustion chamber, not represented in FIG. 2), are connected with each other, and in the same way the backup or stagnation points S of the air inlet openings located on the outside in the radial direction are also connected with each other, a ring is formed by this, which is identified by the reference numeral 10' (see FIG. 2)

In the same way the backup points S of the mounting openings 10 form a ring, identified by reference numeral 12', when all inside located stagnation backup points and all outside located stagnation points are respectively connected with each other via a circle, whose center is the central axis Z.

If it is now assured by a suitable arrangement and embodiment of the mounting openings 12 in respect to the air inlet openings 10, that the ring 12' is not located outside of the ring 10', it is then assured by means of the pressure and flow conditions of the airflow which is supplied in accordance with the direction of the arrows X (see FIG. 1), that no partial airflow can reach the outside in the opposite direction of the arrow X from the space 13 via the mounting openings 12. Instead, an additional airflow is conducted into the space 13 via the mounting openings 12, which is basically desirable.

The importance of the formulation that the ring 12' does not lie outside of the ring 10' becomes particularly clear from FIG. 2, in accordance with which the inner radius $R_i$ of the ring 12' related to the central axis Z is greater than that of the ring 10' and that the outer radius $R_a$ (of course also related to the central axis Z) of the ring 12' is less than that of the ring 10'. In this way the ring 12' is quasi completely covered by the ring 10'.

The definition of the rings 12' and 10', however, can also be made in a simplified manner, i.e. not by means of the stagnation points S, although this definition by means of the stagnation points S represents the physical conditions particularly well and can also explain the desired effect in particular by means of the physical conditions. However, the design in accordance with the invention can also be described in a simpler way in that the air inlet openings 10 themselves constitute a ring 10", within which and not outside of which the mounting openings 12 should be located.

In other words, this means that all air inlet openings 10 describe a ring 10", on whose ring surface the air inlet openings 10 are located exactly adapted in the radial direction. The outer radius $R_a$ of this ring 10" therefore corresponds to the maximum extension $R_x$ of the air inlet opening 10 in the radial direction (in respect to the central axis Z), while the inner radius $R_i$ of the ring 10" corresponds to the minimum extension $R_y$ of the air inlet openings 10 in the radial direction.

Now, if no mounting opening 12 lies even partially outside of the ring 10", the above described flow conditions occur again, so that assuredly no partial air flow can penetrate from the space 13 toward the outside via the mounting openings 12 in the direction opposite the arrow X.

As FIGS. 3*a*, 3*b* show, the head section 1 has flow-dynamically designed opening edges 14, which project from the outside to the inside (i.e. into the space 13) in the area of the air inlet openings 10 and in the area of the mounting openings 12, because by means of this the flow conditions, i.e. in particular the inflow of the air flow into the space 13 in accordance with the direction of the arrow X, are improved. However, like a multitude of other details, in particular of a structural type, this can easily be designed in a way differing from the represented exemplary embodiment without departing from the contents of the claims.

What is claimed is:

1. A combustion chamber of a gas turbine, comprising:

a ring-shaped head section, including a front plate for receiving a plurality of burners, which burners are supplied with a primary airflow via a plurality of annularly arranged air inlet openings in the head section, the front plate also including at least one heat shield in a combustion chamber burner section, attached by a plurality of bolt connections, wherein mounting openings for the bolt connections are provided in the head section, and are located inside of an annular ring formed between radially inner and radially outer dimensions of the air inlet openings.

2. The combustion chamber of a gas turbine as in claim 1, wherein the area of the air inlet openings the mounting openings has an aerodynamically designed opening edge, which projects from an exterior to an interior of the air inlet opening.

3. The combustion chamber of a gas turbine as in claim 1, wherein the area of the mounting openings has an aerodynamically designed opening edge, which projects from an exterior to an interior of the mounting opening.

4. The combustion chamber of a gas turbine as in claim 2, wherein the area of the mounting openings has an aerodynamically designed opening edge, which projects from an exterior to an interior of the mounting opening.

5. A combustion chamber of a gas turbine with a ring-shaped head section, comprising:

a front plate for receiving a plurality of burners, which burners are supplied with a primary airflow via a plurality of annularly arranged air inlet openings in the head section, the front plate also including at least one heat shield provided in a combustion chamber burner section, attached by a plurality of bolt connections, wherein radially inner and radially outer stagnation points which are formed on the exterior of the head section with respect to the inflow to the air inlet openings form radially inner and radially outer boundaries of an annular air inlet opening ring, with the air inlet openings being located between the radially inner and outer boundaries of the air inlet opening ring, and a plurality of mounting openings for the bolt connections also being provided in the head section, with radially inner and radially outer stagnation points which are formed on the exterior of the head section with respect to the inflow to the mounting openings forming an annular mounting opening ring, with the mounting opening ring located between the radially inner and outer boundaries of the air inlet opening ring.

6. The combustion chamber of a gas turbine as in claim 5, wherein the area of the air inlet openings has an aerodynamically designed opening edge, which projects from an exterior to an interior of the air inlet opening.

7. The combustion chamber of a gas turbine as in claim 5, wherein the area of the mounting openings has an aerodynamically designed opening edge, which projects from an exterior to an interior of the mounting opening.

8. The combustion chamber of a gas turbine as in claim 6, wherein the area of the mounting openings has an aerodynamically designed opening edge, which projects from an exterior to an interior of the mounting opening.

* * * * *